United States Patent [19]

Hyodo

[11] Patent Number: 4,869,188

[45] Date of Patent: Sep. 26, 1989

[54] COLOR DISPLAY APPARATUS IN SEWING MACHINE

[75] Inventor: Toru Hyodo, Tokyo, Japan

[73] Assignee: Janome Sewing Machine Company Limited, Tokyo, Japan

[21] Appl. No.: 276,067

[22] Filed: Nov. 25, 1988

[30] Foreign Application Priority Data

Nov. 27, 1987 [JP] Japan ..... 62-297378

[51] Int. Cl.[4] ..... D05B 3/02

[52] U.S. Cl. ..... 112/445; 112/458; 112/121.11

[58] Field of Search ..... 112/445, 453, 456, 458, 112/121.11, 121.12, 103; 364/470

[56] References Cited

U.S. PATENT DOCUMENTS 4,341,170 7/1982 Beckerman et al. ..... 112/445

4,526,116 7/1985 Mannel ..... 112/103 X

FOREIGN PATENT DOCUMENTS 0077888 5/1984 Japan ..... 112/121.11

0137096 8/1984 Japan ..... 112/121.11

*Primary Examiner*—Peter Nerbun

*Attorney, Agent, or Firm*—Frishauf, Holtz, Goodman & Woodward

[57] ABSTRACT

A color display apparatus adapted to be used in an electronic sewing machine. The apparatus consists of a sewing pattern selector, a color display for displaying the pattern selected by the selector, a fabric color sensing system, an upper thread color sensing system, and a display color controller. Fabric color information, upper thread color information, and pattern information are inputted to the display color controller. The controller operates the color display. An operator monitors the matching condition of the color of the fabric and upper thread in order to obtain the desirable matching of them in the pattern selected by means of the display color controller.

5 Claims, 4 Drawing Sheets

COLOR DISPLAY APPARATUS IN SEWING MACHINE

BACKGROUND OF THE INVENTION

The present invention relates to a color display apparatus adapted to a sewing machine, in particular, to a color contrast display apparatus for showing a matching condition of a pattern selected to be stitched with an upper thread of a color selected, and a fabric on which the pattern is stitched.

Nowadays, monochrome display apparatuses have been used in order to display a selected pattern only for comfirmation thereof by the machine operator. Namely, the conventional display apparatus has been only to display a selected pattern with a predetermined single color only for confirmation by the machine operator.

Therefore, it has been difficult for the sewer to determine the upper thread of most appropriate or desirable color in contrast to the color of the fabric to be stitched with the thread.

As a result, it has often been necessary to carry out a trial sewing operation on a fabric in order to recognize, previously if the color of the thread is suitable to the color of the fabric or vice versa. Actually, it is troublesome and wasteful to do such a trial sewing.

SUMMARY OF THE INVENTION

It is therefore a general object of the present invention to provide a color display apapratus adapted to a sewing machine, enabling the operater to easily confirm if a color of upper thread is suitable in contrast to a color of fabric to be stitched with the thread. More particularly it is an object of the present invention to provide a method and an apparatus for displaying a selected pattern to be stitched with an upper thread of its own color in combination with a color of a fabric on which the selected pattern is stitched in the manner that the selected pattern is actually formed on the fabric.

The other objects, features and advantages of the present invention will be more fully apparent from the following description.

BRIEF DISCRIPTION OF THE DRAWINGS

Figure 1:
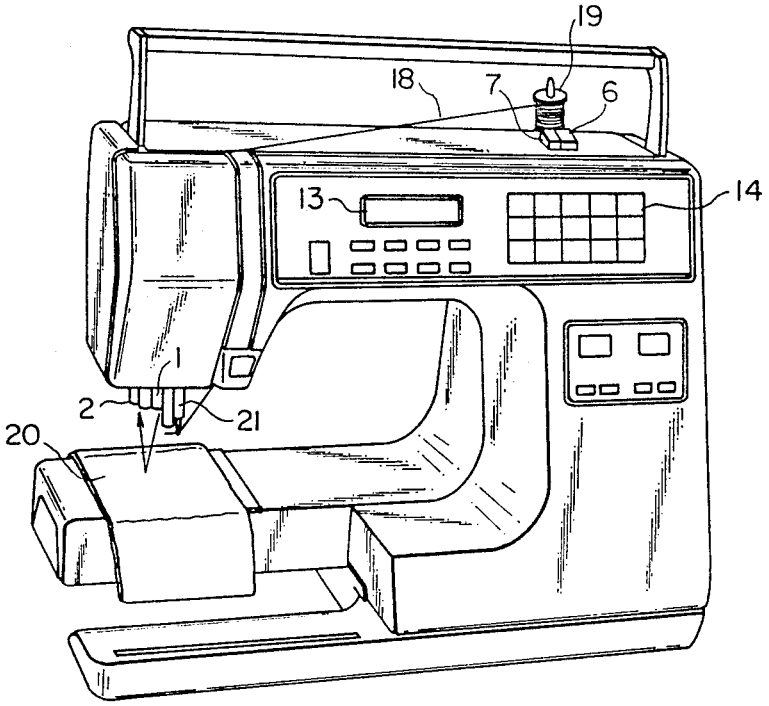
FIG. 1 is a perspective view of the first embodiment of an electronic computerized sewing machine incorporating mainly a color display and a color display color control device.

The manner of operation of the various units in the embodiments of the present invention will be described in connection with the accompanying drawings. As shown in FIG. 1, the electronic sewing machine according to the present invention has a pattern selecting means 14 and a color display screen 13, respectively attached on a front face of the sewing machine. Furthermore, the sewing machine has two pairs of a light source 1 and a color sensor 2 for detecting a color of the fabric and of another light source 6 and another color sensor 7 for detecting a color of the upper thread. The former pair is situated on the top of the sewing machine and the latter one is placed near the thread stand.

Figure 2:
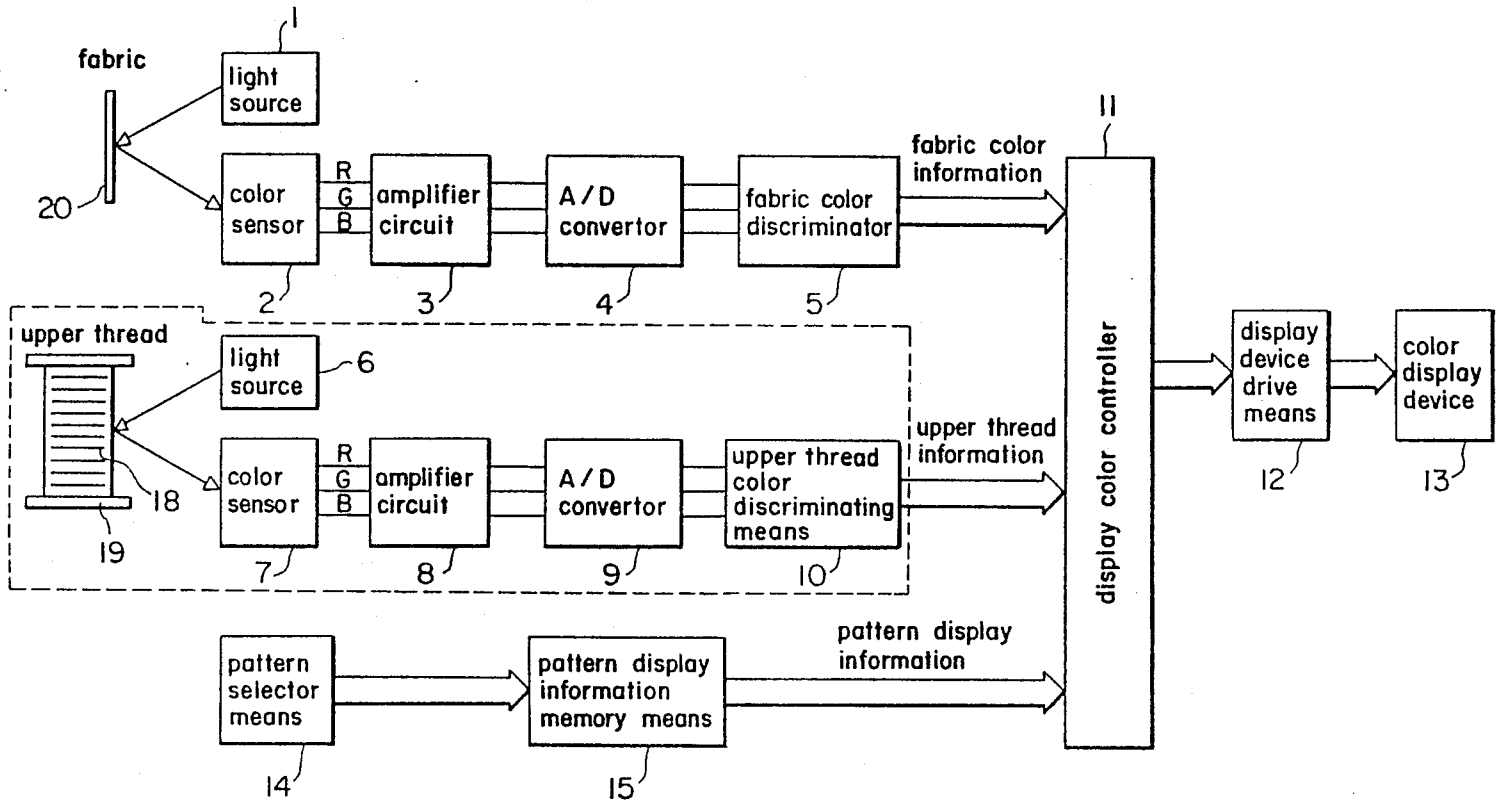
FIG. 2 is a block diagram showing an electronic construction of the sewing machine according to the first embodiment.

It is apparent in FIG. 2 that a pattern selection means 14 consists of a plurality of keys or push buttons used to select the pattern the machine operater wants to stitch on the fabric.

These light sources 1 and 6 light up the fabric and the upper thread wound around a bobbin placed atop of the body of the sewing machine. These light sources diminish any variation in sensibility of the color sensors due to the wide range of brightness of the surroundings. The color sensors 2 and 7 receive light beams from the sources 1 and 6 after reflecting on the fabric material and the upper thread on the bobbin. It is of course, accordingly, that the light beams contain respective information of color of the fabric and the thread.

In accordance with the first embodiment of the present invention, the color sensors 2 and 7, respectively of a type of amorphous integration function on the basis of a three primary color resolution principle. That is, each color sensor has three photo diodes, respectively provided with one of three color filters of Red, Green, and Blue and these photo diodes, respectively have an output terminal. The light beam passed through the three color filters after it is reflected from the fabric and the upper thread is resolved into three primary colors of R, G, and B.

The electronic construction of the sewing machine according to the present invention has amplifier circuits 3 and 8 as shown in Fig 2. The amplifier circuit 3 or 8 receives color signals R, G, and B from the color sensor 2 or 7 and amplifies these color signals. The light sources 1 and 6 tentatively apply a light to three sample bodies of red, green and blue colors. The color sensor 2 or 7 is responsive to the light reflected from each of the sample bodies of different colors to produce the color signals R, G, and B of different voltage levels. The amplifier circuit 3 or 8 amplifies the color signals R, G, and B with the respective amplification factor for producing the amplified outputs R, G, and B of a same voltage level.

Analog/digital convertors 4 and 9 convert an analog value of the amplified signals of R, G, and B into digital values of them and output these digital values.

A fabric color discriminating means 5 discriminate or recognize the particular color of the fabric material using a ratio of the digital values of each R, G, and B signal outputted from the analog/digital converter 4.

An upper thread color discriminating means 10 in the electronic sewing machine of the present invention discriminates the color of an upper thread using a ratio of the digital values of each R, G, and B signal outputted from another converter 9.

A pattern display information memory means 15 reads out a pattern display information corresponding to the pattern selected by the pattern selecting means 14 and outputs the pattern display information.

A display color control means 11 controls the color used in displaying the selected pattern to make the color identical with that of the upper thread on the basis of the upper thread color information outputted from the upper thread color discriminating means 10 and the pattern display information outputted from the pattern display information memory means 15. In addition, the display color control means 11 adjusts the color of the whole portion of the display screen except the pattern displaying portion thereof making the color identical with that of the fabric material on the basis of a fabric color information received from the fabric color discrimination means 5.

A color graphic display device, for example, LCD (liquid crystal display), a fluorescent display tube, and the like are used as the color display screen or device 13. The display screen has a number of display elements of the three primary colors; red, green, and blue. Three elements of the colors construct the single dot of the screen. Each element of red, green or blue has three stages or degrees in brightness of light-ON, light-OFF and intermediate level.

A display device drive means 12 controls or drives every dot in the color display device 13 to display on the basis of display color information of a single dot outputted from the display color control means 11.

Figure 4:
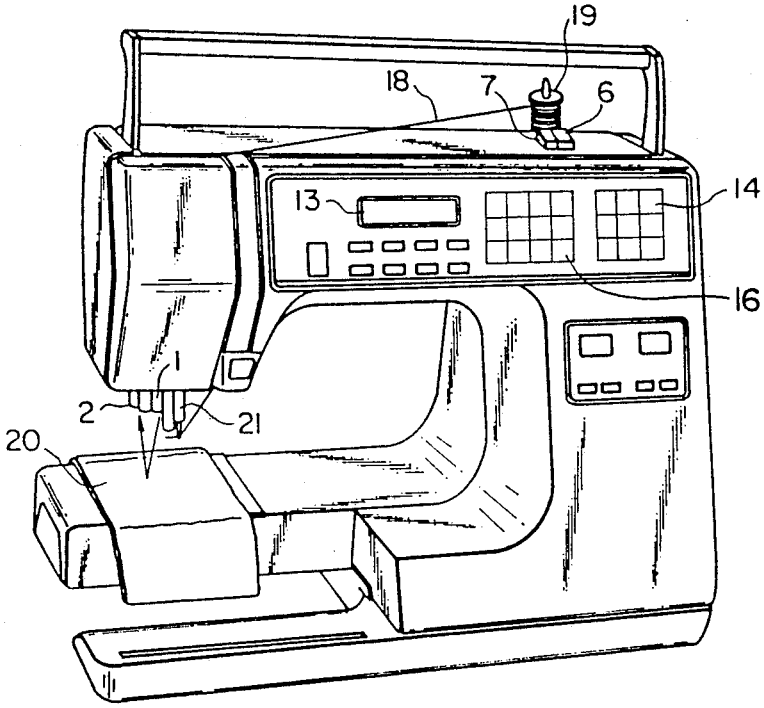
FIG. 4 is a perspective view of the second embodiment of the present invention.
Figure 5:
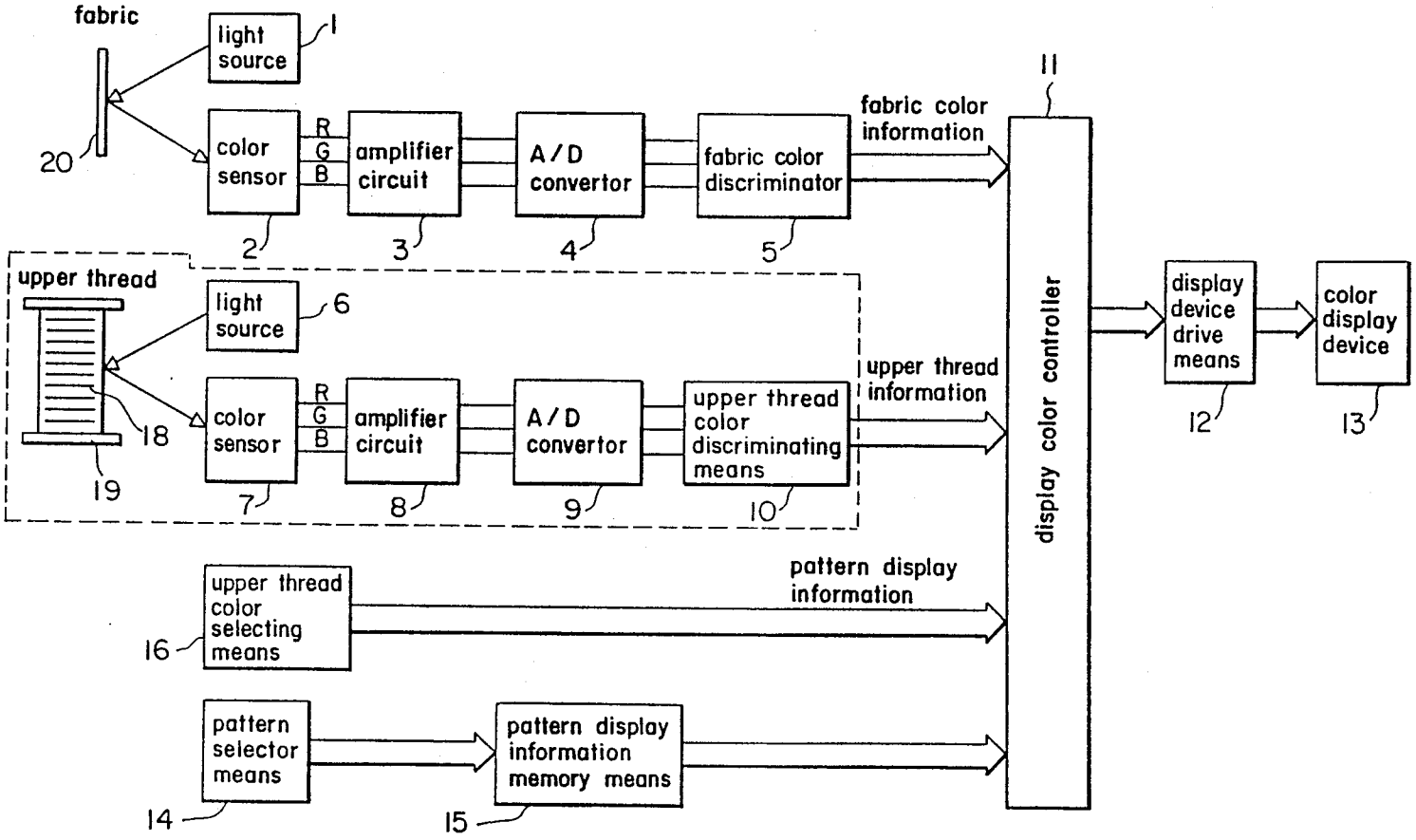
FIG. 5 is a block diagram showing an electronic construction of the sewing machine according to the second embodiment.

In accordance with the second aspect or embodiment of the present invention, an upper thread color selecting means 16 consisting of a plurality of keys or push buttons adapted to be used to select the color of an upper thread the operator wants to employ in stitches on the fabric is used in the electronic sewing machine as shown in FIG. 4. This upper thread color selecting means 16 can be employed in addition to the bobbin system consisting of the pair of the light source 6 and the color sensor 7.

In the second embodiment as shown in FIG. 4, the display color control means 11 controls the color for displaying the selected pattern so as to make it identical with the color selected for the upper thread on the basis of the pattern display information outputted from the pattern display information memory means 15 and of the upper thread color information selected by the upper thread color selecting means 16. Also, the display color control means 11 controls the color of displaying the remaining portion of the display except the pattern displaying portion so as to make it identical with the color of the fabric on the basis of a fabric color information inputted from the fabric color discrimination means 5. It is apparent that the construction of the electronic sewing machine shown in FIG. 4 is obtained by adding the mechanism concerning the upper thread color selecting means 16 to the structure of the sewing machine shown in FIG. 1.

The operation of the color display apparatus adapted to use in an electronic sewing machine according to the present invention will be explained.

(a) Supposing that the color of a fabric is white; a light beam from the light source 1 is reflected on the fabric and passes through respective filters of R(red), G(green), and B(blue) installed in the color sensor 2. Consequently, photovoltaic effect is generated in the photodiodes, respectively installed concerning these filters above.

(b) The voltages photovoltaically generated in the photodiodes corresponding to R, G, and B are transferred to values digitally expressed by means of an amplifier circuit 3 and an analog/ digital converter 4.

(c) The fabric color discriminating means 5 adds the digital values of R, G, and B inputted therein obtaining a total value (T) of three digital values (RD, GD, and BD). The means 5 calculates each compositional ratio (Rx, Gx, and Bx) to the total value (T) and judges the color on the basis of the calculation result.

The explanation above is expressed as shown below;

$$T=RD+GD+BD$$

$$Rx=RD/T$$

$$Gx=GD/T$$

$$Bx=BD/T$$

Then the fabric color discriminating means 5 discriminates the color of the fabric using the comparison result of each rational value of Rx, Gx, and Bx and finds it is white.

(d) Supposing that the color of a upper thread is red; a light beam from the light source 6 is reflected from the upper thread wound on a bobbin as shown in FIG. 2 to the color sensor 7 generating voltage due to photovoltaic effect.

(e) Each voltage is transferred and expressed by digital values by means of the amplifier circuit 8 and the analog/digital converter 9.

(f) The upper thread color discriminating means 10 calculates, as described in (c) above, the proportional ratios Rx, Gx, and Bx of colors of R(red), G(green), and B(blue) and compares them to each other, discriminating and finding the color is red.

(g) When the pattern selecting means 14 selects a pattern of alphabet "A", the means 14 outputs information of the pattern A.

(h) The pattern display information memory means 15 reads out a unit pattern display information of a dot in the display device on the basis of the information of the selected pattern "A" from the pattern selecting means 14 and outputs the unit pattern display information.

(i) The display color control means 11 controls each dot color of the display device depicting the pattern "A" on the basis of the pattern display information obtained from the pattern display information memory means 15 and makes the dot color red according to the red information of the upper thread color discriminating means 10. And also, the control means 11 controls the color of the dot not corresponding to the pattern "A" making it white according to the white information from the fabric color discriminating means 5.

(j) In order to make a dot red color, only the red color element among three elements each corresponding to red, green and blue included in one dot of the color display device is made effective. Similarly, if you want to make the particular dot white, it is necessary to make simultaneously three elements of red, green and blue by a suitable means.

(k) The display device drive means 12 outputs a drive signal of, for example, a time division type, to the color display device in accordance with the control information outputted from the display color control means 11.

(l) The color display device 13 displays the effective elements of red, green, and blue contained in and corresponding to one dot in accordance with a drive signal applied to the effective elements.

Figure 3:
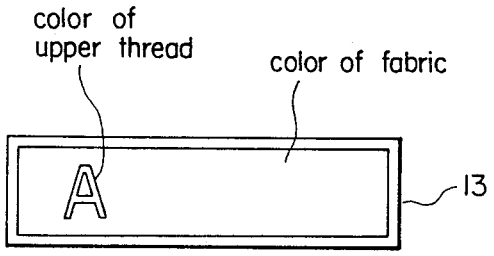
FIG. 3 is an example of displaying a selected pattern having a color of upper thread to be used in combination with a color of fabric to be stitched.

In the example of the color display device 13 shown in FIG. 3, the portion of the pattern "A" is colored red corresponding to that of the upper thread and the remaining portion of the device is colored white corresponding to the of the fabric.

According to other embodiment of the color display apparatus of the present invention, the color of the upper thread is selected by means of the upper thread color selecting means 16 in the different display apparatus shown in FIG. 4. The upper thread color information outputted from the color selecting means 16 is inputted to the display color control means 11. The succeeding operation of the color display apparatus is identical with that of the previous embodiment of the present invention.

I claim:

1. A color display apparatus for a sewing machine comprising pattern selecting means for selecting a pattern to be stitched, color display means for displaying the selected pattern, a first sensor for detecting the color of a fabric to be sewn, a fabric color discriminating means for discriminating the fabric color on the basis of information produced from said first sensor, a second sensor for detecting the color of an upper thread, an upper thread color discriminating means for discriminating the color of the upper thread on the basis of information produced from the second sensor, and a color display control device for displaying the selected pattern in said color display means on the basis of information produced from said upper thread discriminating means by means of the specific color of the upper thread to be employed and for displaying the specific color of the fabric to be sewn in the remaining portion of said color display means on a basis of information produced from said fabric color discriminating means.

2. The color display apparatus for a sewing machine according to claim 1, further comprising a first light source cooperating with the fabric to be sewn to give color information to said first sensor, and a second light source cooperating with the upper thread to be employed to give color information to said second sensor.

3. The color display apparatus for a sewing machine according to claim 1, further comprising an upper thread color selecting means comprising a plurality of keys, wherein said color display control device controls the color of the upper thread on the basis of the color information of the upper thread selected by said upper thread color selecting means.

4. The color display apparatus for a sewing machine according to claim 1, wherein each color sensor is of the amorphous integrated type employing a three primary color resolution method and each color sensor has three photo diodes provided with three color filters for resolving the light beam into red, green, and blue colors.

5. The color display apparatus for a sewing machine according to claim 1, further comprising an amplifier circuit, an analog/digital converter, a color discriminating means connected to each color sensor through said amplifier circuit and said analog/digital converter, and a display device drive means, wherein the fabric color information and the upper thread color information respectively obtained from said color discriminating means are supplied to said color display control device to which said pattern selecting means is connected through pattern display information memory means, and to which said color display means is connected through said display device drive means.

* * * * *